US011739747B2

(12) United States Patent
Son et al.

(10) Patent No.: US 11,739,747 B2
(45) Date of Patent: Aug. 29, 2023

(54) VIBRATION DAMPING STRUCTURE FOR A COMPRESSOR AND A COMPRESSOR INCLUDING VIBRATION DAMPING STRUCTURE

(71) Applicant: LG ELECTRONICS INC., Seoul (KR)

(72) Inventors: Young Boo Son, Seoul (KR); Jinkook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 327 days.

(21) Appl. No.: 17/183,643

(22) Filed: Feb. 24, 2021

(65) Prior Publication Data

US 2021/0293233 A1 Sep. 23, 2021

(30) Foreign Application Priority Data

Mar. 17, 2020 (KR) ..... 10-2020-0032716

(51) Int. Cl.
*F04B 53/00* (2006.01)
*F04B 39/12* (2006.01)

(52) U.S. Cl.
CPC ..... *F04B 53/003* (2013.01); *F04B 39/121* (2013.01); *F04B 39/127* (2013.01)

(58) Field of Classification Search
CPC .... F04B 53/003; F04B 39/121; F04B 39/127; F04B 39/0044; F04B 39/023; F05B 2260/96
USPC ..... 417/363
See application file for complete search history.

(56) References Cited

U.S. PATENT DOCUMENTS 2,977,043 A * 3/1961 Scheldorf ..... F04B 39/127 206/591
3,586,456 A * 6/1971 Giacosa ..... F25B 31/023 417/372
3,606,594 A * 9/1971 Lewis et al. ..... F25B 31/02 417/415
4,360,087 A * 11/1982 Curwen ..... F04B 39/0044 188/379

(Continued)

FOREIGN PATENT DOCUMENTS

JP 2001-013285 1/2001
JP 2003-336688 11/2003

(Continued)

OTHER PUBLICATIONS

Korean Notice of Allowance dated May 18, 2021.
European Search Report issued in Application No. 21161934.1 dated May 31, 2021.

*Primary Examiner* — Kenneth J Hansen
*Assistant Examiner* — Benjamin Doyle
(74) *Attorney, Agent, or Firm* — Ked & Associates, LLP

(57) ABSTRACT

A compressor is provided that is configured to suspend a compressor assembly from a string to significantly expand a speed range in which the compressor may be operated. The compressor may include a shell, and a compressor assembly disposed in the shell. The shell and the compressor assembly may be connected to each other by a string. The compressor assembly may be suspended from the shell by the string, and a tensile force may be generated at the string due to self-weight of the compressor assembly. A frame of the compressor assembly may not directly contact the shell.

20 Claims, 17 Drawing Sheets

(56) References Cited

U.S. PATENT DOCUMENTS

| | | | | |
|---|---|---|---|---|
| 4,363,217 | A * | 12/1982 | Venuti | F04B 37/08 62/55.5 |
| 4,854,131 | A * | 8/1989 | Sakitani | F25B 9/10 248/638 |
| 7,516,597 | B1 * | 4/2009 | Roose | B65B 55/20 53/139.5 |
| 2005/0053489 | A1 | 3/2005 | Noh et al. | |
| 2007/0020122 | A1 * | 1/2007 | Halkyard | F04B 35/045 417/363 |
| 2010/0172769 | A1 * | 7/2010 | Lilie | F04B 35/045 417/363 |
| 2017/0037717 | A1 * | 2/2017 | Oehring | F04B 19/22 |
| 2018/0087494 | A1 | 3/2018 | Brune et al. | |
| 2021/0277886 | A1 * | 9/2021 | Lee | F04B 53/16 |
| 2021/0310470 | A1 * | 10/2021 | Lee | F04B 39/10 |
| 2022/0389919 | A1 * | 12/2022 | Kim | F04B 35/045 |

FOREIGN PATENT DOCUMENTS

| | | |
|---|---|---|
| KR | 10-1999-0058920 | 7/1999 |
| KR | 10-2005-0064192 | 6/2005 |
| KR | 10-2010-0019996 | 2/2010 |
| KR | 10-2017-0124889 | 11/2017 |
| WO | WO 00/70223 | 11/2000 |
| WO | WO 02/06698 | 1/2002 |
| WO | WO 2006/049511 | 5/2006 |

* cited by examiner

VIBRATION DAMPING STRUCTURE FOR A COMPRESSOR AND A COMPRESSOR INCLUDING VIBRATION DAMPING STRUCTURE

CROSS-REFERENCE TO RELATED APPLICATION(S)

This application claims priority to and the benefit of Korean Patent Application No. 10-2020-0032716, filed in Korea on Mar. 17, 2020, the disclosure of which is incorporated herein by reference in its entirety.

BACKGROUND

1. Field

A vibration damping structure for a compressor and a compressor including a vibration damping structure are disclosed herein.

2. Background

Compressors may compress gas to increase pressure. Compressors may be classified into a reciprocating compressor configured to convert a rotational motion of a crankshaft into a linear reciprocating motion of a piston and compress gas suctioned into a cylinder using a piston and discharge the compressed gas, a linear compressor configured to linearly reciprocate a piston without a crankshaft, a scroll compressor configured to compress gas by relatively rotating two scrolls, and a rotary compressor configured to compress fluid based on eccentrically rotating a roller inside of a cylinder, according to gas compressing mechanisms.

For example, the reciprocating compressor and the linear compressor each perform the linear reciprocating motion using the piston, thereby occurring vibration during a reciprocating time period of the piston. The vibration generates noise and also affects the operation of the compressor.

Referring to FIG. 1, a compressor 1 includes a shell 10. The shell 10 separates an inner space of the compressor 1 from an outer space of the compressor 1. Gas to be compressed is introduced into the shell 10. In addition, a compressor assembly 40 is disposed inside of the shell 10 to compress the gas.

The compressor assembly 40 may include a frame 50. A drive source, a piston, and a cylinder are disposed at the frame 50. Vibration is generated in the compressor assembly 40 based on linear reciprocation of the piston. When the vibration is transmitted to the shell 10, loud noise is generated. A damper is disposed between the compressor assembly 40 and the shell 10. The damper may include an elastic body, such as a compression coil spring or a leaf spring. The compressor assembly 40 is disposed inside of the shell 10 and is mounted on the damper. For example, the reciprocating compressor is a vibration system operated based on a mass (M) of the compressor assembly 40 and spring stiffness (K) of the damper.

The vibration system has natural frequency determined based on the mass (M) and the spring stiffness (K). In this case, if the vibration frequency generated in the compressor assembly 40 matches the natural frequency, a magnitude of noise increases and the vibration is amplified. Therefore, an operating speed range in which the compressor 1 can be operated is set within a range outside of the natural frequency of the damper.

The natural frequency of the M-K system overlaps with a low-speed range in which the compressor can be operated. If the natural frequency of the M-K system is lowered, the operating speed range in which the compressor 1 can be operated may expand. As the operating speed range in which the compressor 1 can be operated expands, the compressor may be efficiently operated, thereby improving efficiency of the compressor.

However, as there is a limitation to lowering the natural frequency of the M-K system, low-speed operation of the compressor may be limited, thereby inhibiting an increase in efficiency of the compressor. In addition, the spring has an elastic force applying direction. When the spring sufficiently applies the elastic force in a direction of gravity, the spring may not properly apply the elastic force in a horizontal direction.

If a plurality of springs are provided to apply the elastic force in the direction of gravity and the horizontal direction or the spring is provided, as disclosed by U.S. Patent Application Pub. No. US 2018/0087494A1, which is hereby incorporated by reference, in order for the direction applying the elastic force by the spring to include the horizontal direction and the direction of gravity, a number of components may be increased and there may be difficulties in installing and assembling the springs of the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
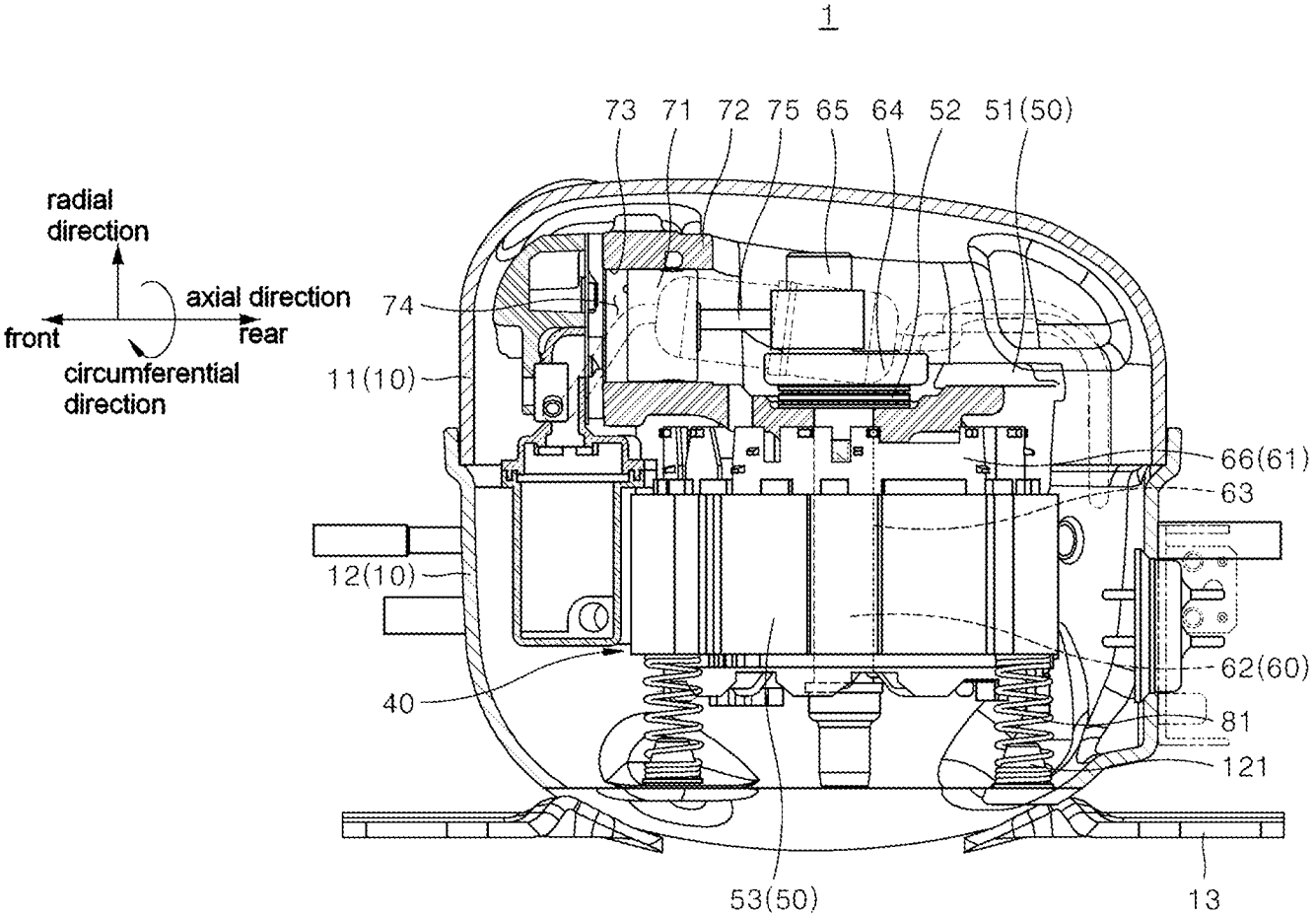
FIG. 1 is a side cross-sectional view showing a reciprocating compressor.

Although embodiments are described with reference to the accompanying drawings, those skilled in the art to which the embodiments pertain may easily implement the technical idea. In the description of embodiments, description of known technology may be omitted if it unnecessarily obscures the gist. Hereinafter, one or more embodiments are described with reference to the accompanying drawings. Same reference numerals may be used to refer to same or similar components in the figures.

In the following description of embodiments, an axial direction refers to a linear reciprocating direction of a piston. A forward direction refers to a direction in parallel to a direction of axially pushing the piston into a cylinder. A rearward direction refers to a direction in parallel to a direction of axially removing the piston from the cylinder. A radial direction refers to a direction moving away from or moving toward the axis. A centrifugal direction refers to a direction moving away from the axis and a centripetal direction refers to a direction moving toward the axis. A circumferential direction or a peripheral direction refers to a direction surrounding a circumference of the axis. In addition, a vertical direction refers to a direction of applying gravity. An upward direction may refer to a direction opposite to the direction of gravity. A horizontal or lateral direction may refer to a direction perpendicular to the axial direction and the vertical direction.

In some examples, terms such as first, second, and the like may be used herein when describing elements, but the elements are not limited to those terms. These terms are intended to distinguish one element from other elements, and the first element may be a second element unless otherwise stated.

Unless otherwise stated, each component may be singular or plural throughout the disclosure.

Further, the terms "connected," "coupled," or the like are used the that, where a first component is connected or coupled to a second component, the first component may be directly connected or able to be connected to the second component, or one or more additional components may be disposed between the first and second components, or the first and second components may be connected or coupled through one or more additional components.

As used herein, the singular forms "a," "an" and "the" are intended to include the plural forms as well, unless the context clearly indicates otherwise. In the present disclosure, it should not be construed that terms such as "including" or "comprising" necessarily include various types of components or various steps described in the present disclosure, and it should be construed terms such as "including" or "comprising" do not include some components or some steps or may include additional components or steps.

Unless otherwise stated, "A and/or B" means A, B or A and B. Unless otherwise stated, "C to D" means "C or more and D or less".

Figure 2:
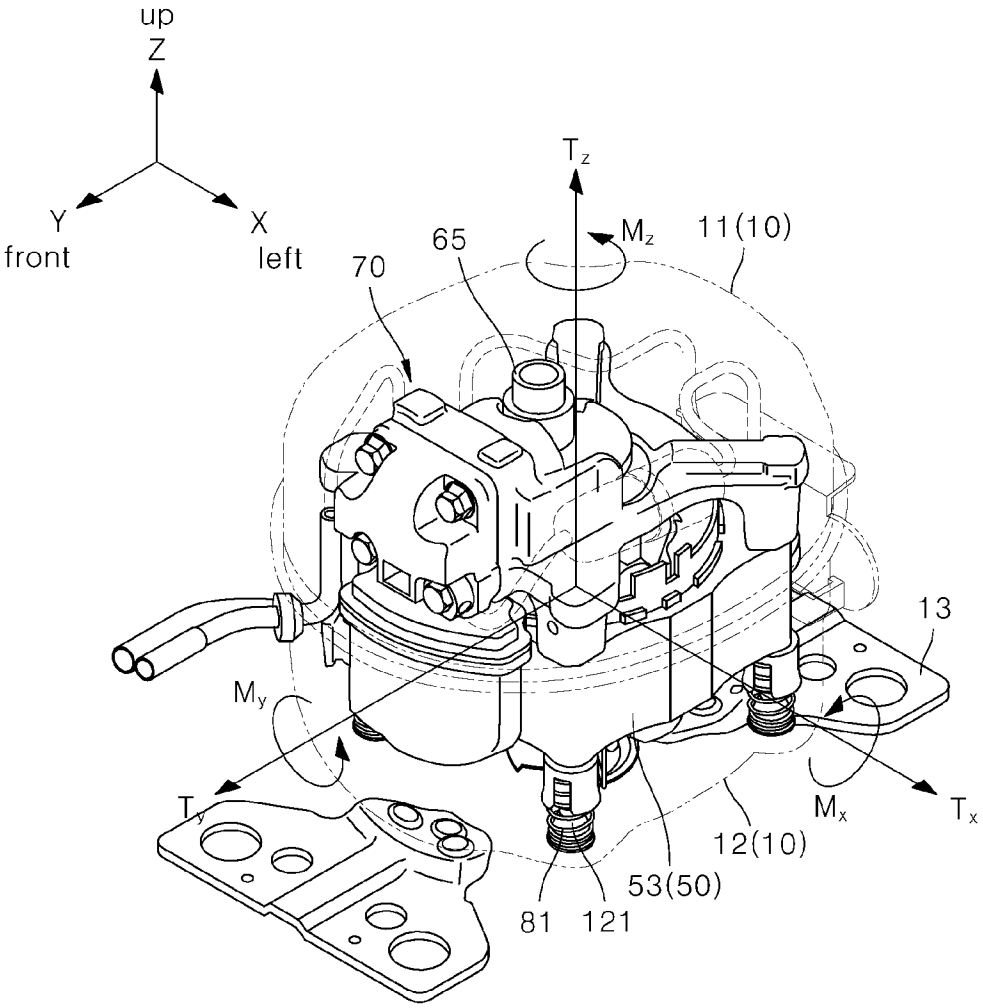
FIG. 2 shows 6-degree-of-freedom (6-DOF) vibration applied to a compressor assembly including a damper using a spring.
Figure 3:
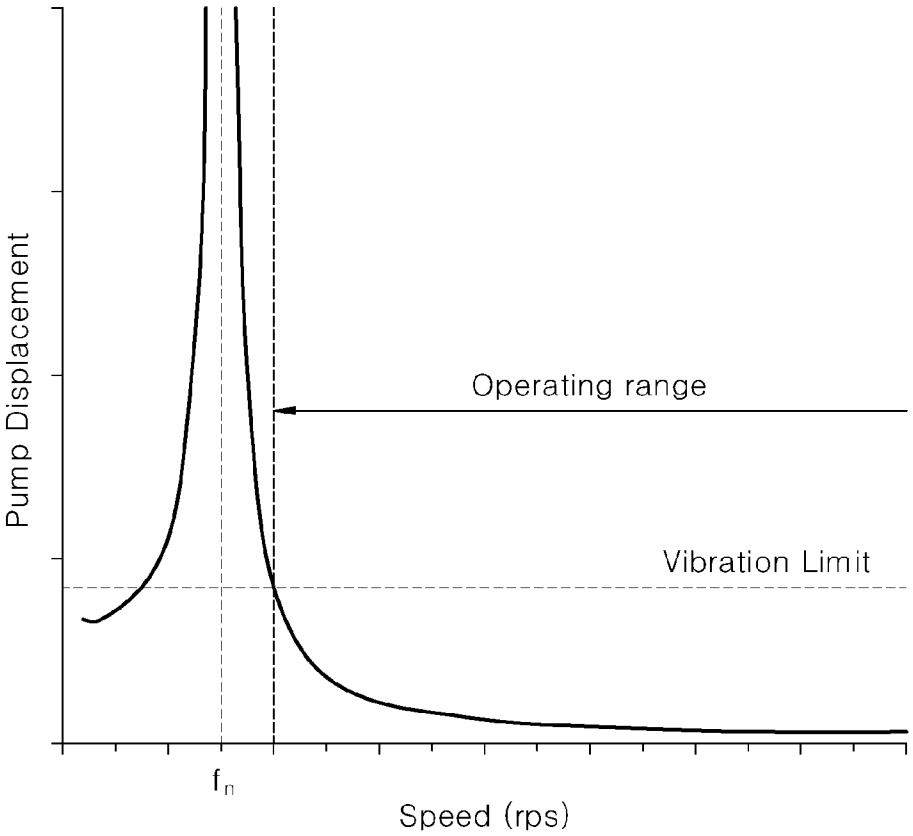
FIG. 3 is a graph showing natural frequency and an operating range of a compressor including a damper using a spring.

With reference to FIGS. 1 to 3, a structure of a compressor using a spring damper is described. Compressor 1 illustrated is a reciprocating compressor. In addition, a vibration damping structure according to embodiments may be applied to a linear compressor including a linearly reciprocating piston. In addition, according to embodiments, the vibration damping structure may also be applied to all vibration-generating compressors.

A compressor assembly 40 of the compressor 1 is disposed inside of a shell 10. The shell 10 may include a lower shell 12 having a deep container shape and an upper shell 11 configured to cover an upper portion of the lower shell 12. Legs 13 may be disposed at a bottom of the lower shell 12. The leg 13 may couple the compressor 1 to an installation position of the compressor 1.

The compressor assembly 40 may include a frame 50, a drive 60, a cylinder 72, and a piston 71. The frame 50 may include a lower frame 53 and an upper frame 51.

The drive 60 may be an electric motor, for example. The electric motor may be a rotational motor, and the rotational motor may include a stator and a rotor relatively rotated by the stator. The electric motor may be a linear motor, and the linear motor may include a stator and a mover to linearly reciprocate relative to the stator. The rotary motor may be used for the reciprocating compressor and the linear motor may be used for the linear compressor.

According to embodiments, a stator 66 of a rotational motor 61 may be coupled to the lower frame 53. A rotary shaft 63 may be concentric with the stator 66 and extend vertically. A rotor 62 may be disposed at the rotary shaft 63 and rotate together with the rotary shaft 63. A disk member 64 may be disposed at an upper end of the rotary shaft 63 to expand a diameter of the rotary shaft 63. A lower surface of the disk member 64 may be supported in a rotational direction and in a thrust direction by a bearing 52 disposed on the upper frame 51. A crank pin 65 may be disposed above the disk member 64 and extend upward from a position eccentric with a center of the rotary shaft 63.

The upper frame 51 may be coupled to the lower frame 53. The upper frame 51 may include a cylinder 72. The cylinder 72 may define a bore 73 that extends in frontward and rearward directions. A piston 71 may be inserted into the bore 73. The cylinder 72 may provide a compression space 74 at a front side of the piston 71. The piston 71 may be connected to the crank pin 65 through a connecting rod 75.

When power is supplied to the motor 61, the rotary shaft 63 rotates and the crank pin 65 rotates around the rotary shaft 63. The connecting rod 75 connected to the crank pin 65 linearly reciprocates the piston 71 forced to be movable in the frontward and rearward directions in the cylinder 72.

Vibration is generated in the compressor assembly 40 during the linear reciprocating time period of the piston 71. A vibration damping structure is disposed between the compressor assembly 40 and the shell 10 to prevent vibration transmission to the shell 10.

Referring to FIG. 1, the shell 10 may define a protrusion 121 at a bottom of an inner space thereof. The protrusion 121 may couple a lower portion of a spring 81, such as a compression coil spring. A frame 50 of the compressor assembly 40 may be coupled to an upper portion of the spring 81. The spring 81 may couple the frame 50 to the shell 10, as well as preventing direct contact of the frame 50 to the shell 10. Therefore, the spring 81 prevents the vibration transmission from the frame 50 to the shell 10.

Referring to FIG. 2, vibration displacement of the compressor assembly 40 is determined based on 6-degree-of-freedom (6-DOF) motion. The 6-DOF motion may be expressed by the following motion equation.

$$[M]X''+[C]X'+[K]X=F(t)$$

The vibration has resonant frequency (also referred to as "natural frequency") determined by a mass (M) and stiffness (K) and is expressed as follows.

$$f_n=\tfrac{1}{2}\pi*(K/M)^{1/2}$$

When the piston 71 linearly reciprocates at a speed within a speed range in which the natural frequency is generated, the vibration is amplified and loud noise is generated. Therefore, an operating range of the compressor 1 may be limited by the resonant frequency as shown in FIG. 3. If the compressor lowers the resonant frequency, the operating range of the compressor 1 may be further obtained in a low-speed range, thereby improving the operating efficiency of compressor 1.

Figure 4:
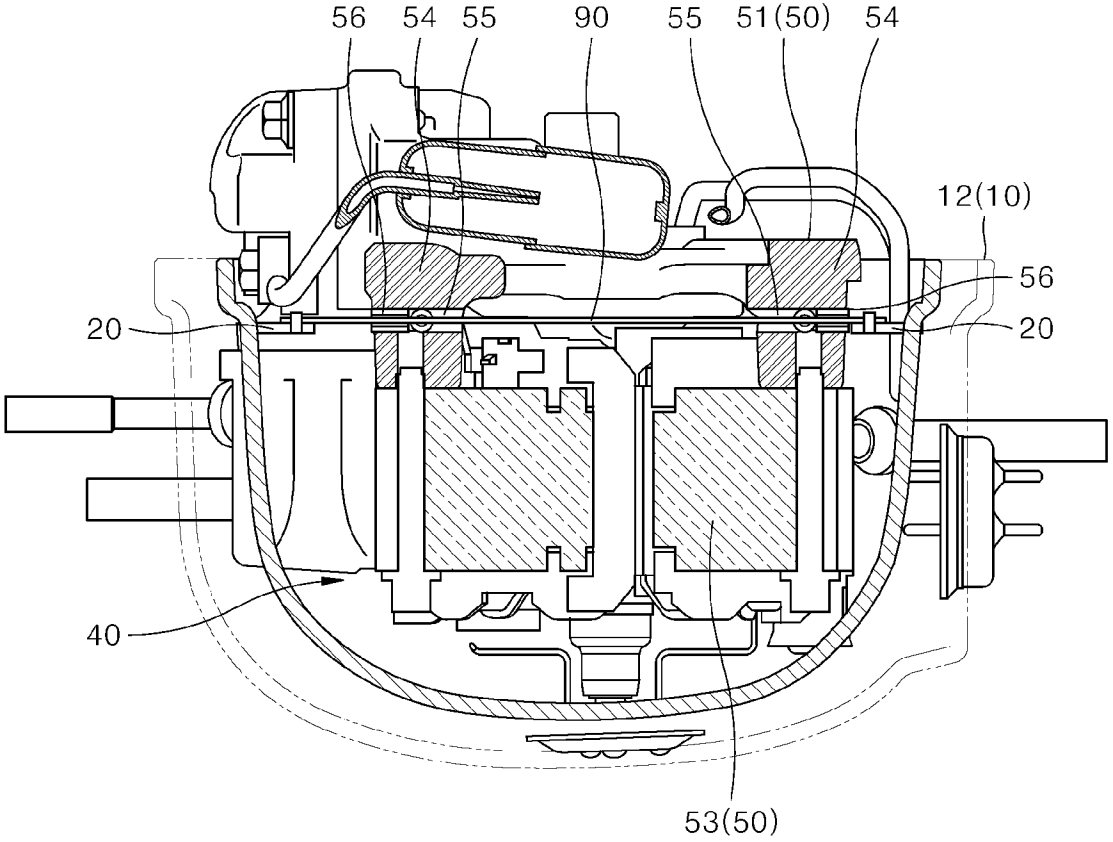
FIG. 4 is a side cross-sectional view of a compressor using a vibration damping structure according to an embodiment.
Figure 5:
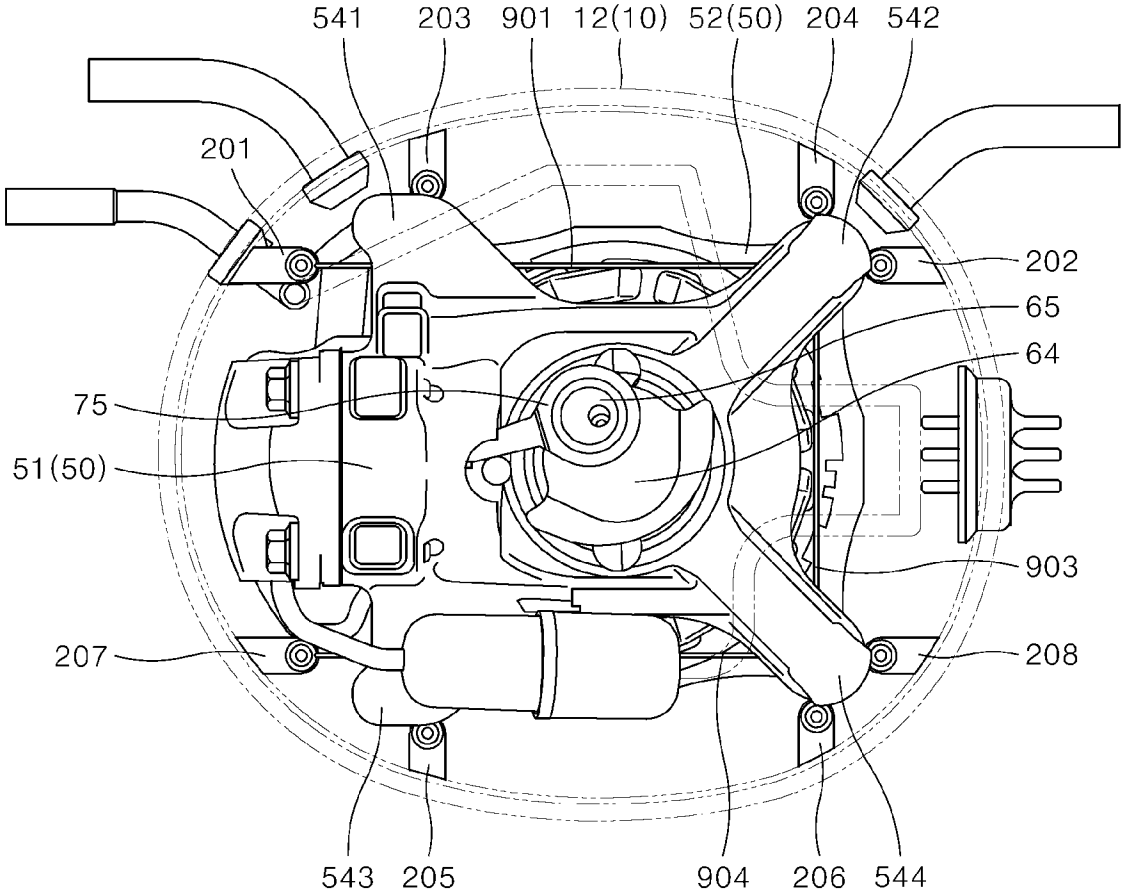
FIG. 5 is a plan view of the compressor of FIG. 4.
Figure 6:
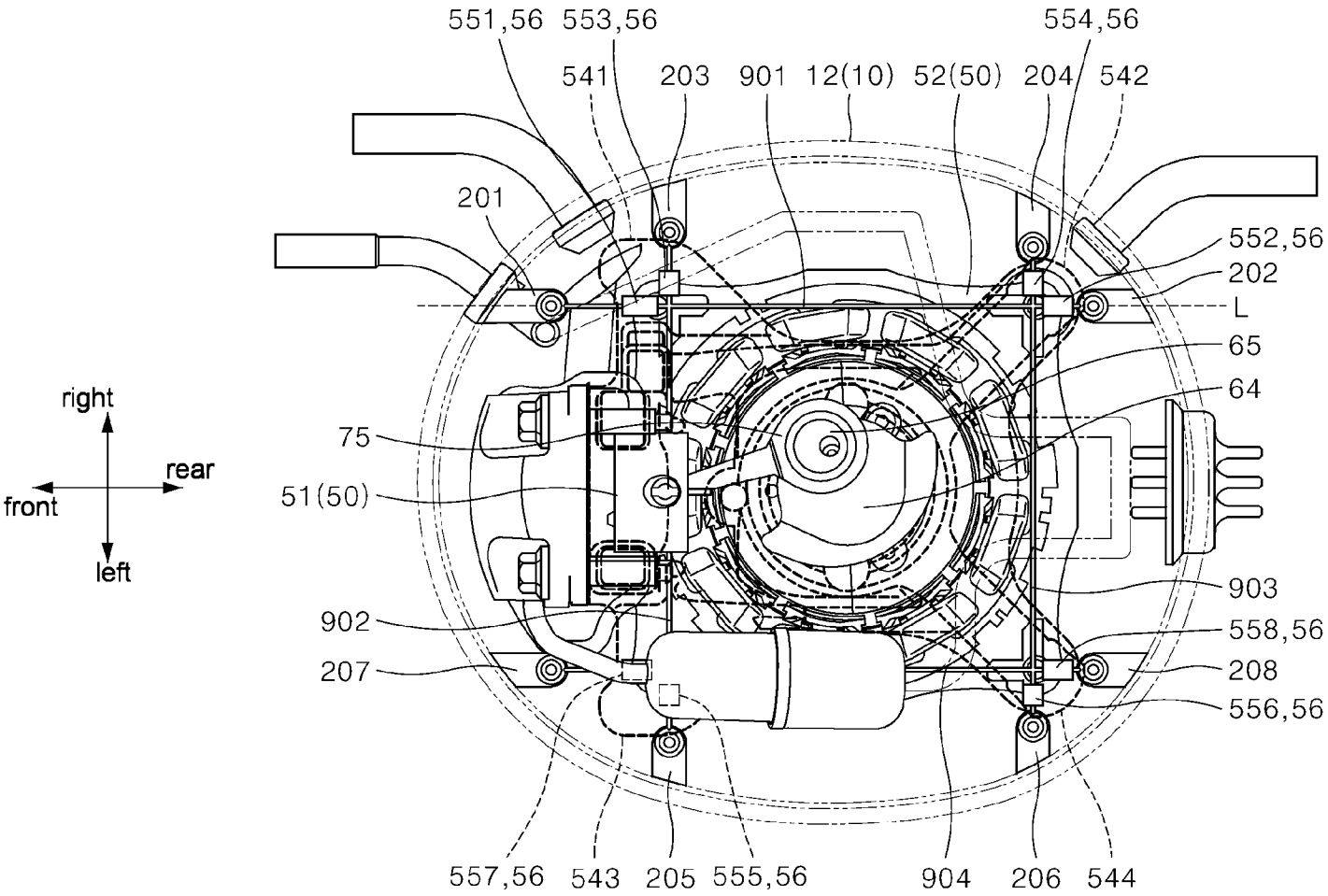
FIG. 6 shows the compressor of FIG. 5, where an upper frame is omitted.

Hereinafter, a vibration damping structure according to an embodiment for expanding an operating range of compressor 1 is described with reference to FIGS. 4 to 8. FIGS. 4 to 6 show a compressor, where an upper shell is omitted.

The vibration damping structure may include a string 90. The string 90 is a flexible component that extends in a longitudinal direction and resists a tensile force generated along the longitudinal direction. The string 90 may also be referred to as a wire, a cable, or a rope. The string may be a bundle of wires formed by twisting a thin metal wire, for example. A synthetic resin may be coated around the string, for example. A synthetic resin material may be a flexible material with a low sliding friction coefficient and a material having high wear resistance.

Shell 10 of the compressor 1 may include a shell string connector 20. The string 90 may be connected and coupled to the shell string connector 20. A first end of the string 90 may be directly coupled to the shell string connector 20. For example, the string 90 may be supported by the shell string connector 20, but not coupled to the shell string connector 20 in the longitudinal direction, and the end of the string 90 may be coupled to another portion of the shell 10. That is, the shell string connector 20 may function as a supporter to support the string 90 from the shell 10.

According to an embodiment, both ends of the string 90 may be supported by the shell 10 of the compressor 1. Further, the compressor assembly 40 may be disposed on the string 90 while being suspended from the string 90.

The string 90 may be supported from an upper portion of the shell 10. According to this embodiment, the shell string connector 20 may be disposed at an upper portion of lower shell 12 and the string 90 may be connected to and supported by the shell string connector 20.

The compressor assembly 40 may include an assembly string connector 54 to connect to the string 90. A through-hole 55 defined at upper frame 51 of frame 50 of the compressor assembly 40 may form the assembly string connector 54. The string 90 may be connected to the compressor assembly 40 through the through-hole 55.

According to the vibration damping structure, both ends of the string 90 may be connected to and supported by the shell 10, the upper frame 51 may be suspended from the string 90, and the lower frame 53 may be coupled to the upper frame 51. In this configuration, the compressor assembly 40 may be disposed inside of the shell 10 while being suspended from the string 90.

As the string 90 passes through the through-hole 55, the compressor assembly 40 may not be coupled to the string 90 in the longitudinal direction of the string 90. For example, the compressor assembly 40 may include a first assembly string connector 541, a second assembly string connector 542, a third assembly string connector 543, and a fourth assembly string connector 544.

The first assembly string connector 541 and the second assembly string connector 542 may be spaced apart from each other by a predetermined distance in a frontward and rearward direction. The third assembly string connector 543 and the fourth assembly string connector 544 may also be spaced apart from each other by a predetermined distance in the forward and rearward direction.

The first assembly string connector 541 and the third assembly string connector 543 may be spaced apart from each other by a predetermined distance in a lateral direction, that is, in a horizontal direction. The second assembly string connector 542 and the fourth assembly string connector 544 may also be laterally spaced apart from each other by a predetermined distance.

The first assembly string connector 541 and the fourth assembly string connector 544 may be disposed opposite to each other with respect to a center of the compressor assembly 40. The second assembly string connector 542 and the third assembly string connector 543 may also be disposed opposite to each other with respect to the center of the compressor assembly 40.

The first to the fourth assembly string connectors 541, 542, 543, and 544 may be disposed at four corners of a rectangle or a square, respectively. The first to the fourth assembly string connectors 541, 542, 543, and 544 may be disposed at positions such that strings 90 passing through the first to the fourth assembly string connectors 541, 542, 543, and 544 do not interfere with the compressor assembly 40.

The first to the fourth assembly string connectors 541, 542, 543, and 544 may be disposed at the upper frame 51 near a portion connected to the lower frame 53. The first to the fourth assembly string connectors 541, 542, 543, and 544 may be provided at portions extending radially outward from the center of the upper frame 51.

The first to the fourth assembly string connectors 541, 542, 543, and 544 may each include two through-holes 55.

The first assembly string connector 541 defines a first through-hole 551 that penetrates in a first direction and the second assembly string connector 542 may define a second through-hole 552 that penetrates in a second direction. The first direction and the second direction may be disposed on a same straight line.

In addition, the first assembly string connector 541 may define a third through-hole 553 that penetrates in a third direction and the second assembly string connector 542 may define a fourth through-hole 554 that penetrates in a fourth direction. The first direction and the third direction may be different directions and the second direction and the fourth direction may be different directions.

The third assembly string connector 543 may define a fifth through-hole 555 that penetrates in a fifth direction and the fourth assembly string connector 544 may define a sixth through-hole 556 that penetrates in a sixth direction. The third direction and the fifth direction may be disposed on a same straight line and the fourth direction and the sixth direction may be disposed on a same straight line.

In addition, the third assembly string connector 543 may define a seventh through-hole 557 that penetrates in a seventh direction and the fourth assembly string connector 544 may define an eighth through-hole 558 that penetrates in an eighth direction. The fifth direction and the seventh direction may be different directions and the sixth direction and the eighth direction may be different directions. The seventh direction and the eighth direction may be disposed on a same straight line.

The through-holes 55 of the two different assembly string connectors 54 may have penetrating directions corresponding to each other. The through-hole 55 may have an inner peripheral surface to minimize friction generated based on contact with the string 90. The surface may be provided by a bushing 56 inserted into the through-hole 55. The bushing 56 may be partially or entirely inserted into the through-hole 55 in the longitudinal direction. In this embodiment, an example is described in which the bushing 56 is partially inserted into the through-hole 55.

The string 90 may include a first string 901 to a fourth string 904. A first string 901 may pass through the first through-hole 551 and the second through-hole 552. A second string 902 may pass through the third through-hole 553 and the fifth through-hole 555. A third string 903 may pass through the fourth through-hole 554 and the sixth through-hole 556. A fourth string 904 may pass through the seventh through-hole 557 and the eighth through-hole 558.

The compressor assembly 40 may be suspended from one string at two different positions to easily balance a level of the compressor assembly 40 for maintaining stable suspension of the compressor assembly 40, and distribute and transmit a load of the compressor assembly 40 to one string.

A front end, which is a first end of the first string 901, may be connected to the first shell string connector 201 disposed at a right (first) front side of the shell 10 and a rear end, which is a second end of the first string 901, may be connected to the second shell string connector 202 disposed on a right (first) rear side of the shell 10. The compressor assembly 40 may be suspended from the shell 10 by the first through-hole 551, the second through-hole 552, and the first string 901.

A right end, which is a first end of the second string 902, may be connected to the third shell string connector 203 disposed at the right front side of the shell 10 and a left end, which is a second end of the second string 902, may be connected to the fifth shell string connector 205 disposed at a left (second) front side of the shell 10. The compressor assembly 40 may be suspended from the shell 10 by the third through-hole 553, the fifth through-hole 555, and the second string 902.

A right end, which is a first end of the third string 903, may be connected to the fourth shell string connector 204 disposed at the right rear side of the shell 10 and a left end, which is a second end of the third string 903, may be connected to the sixth shell string connector 206 disposed at a left (second) rear side of the shell 10. The compressor assembly 40 may be suspended from the shell 10 by the fourth through-hole 554, the sixth through-hole 556, and the third string 903.

A front end, which is a first end of the fourth string 904, may be connected to the seventh shell string connector 207 disposed at the front left side of the shell 10 and a rear end, which is a second end of the fourth string 904 may be connected to the eighth shell string connector 208 disposed at the rear left side of the shell 10. The compressor assembly 40 may be suspended from the shell 10 by the seventh through-hole 557, the eighth through-hole 558, and the fourth string 904.

The first shell string connector 201 and the third shell string connector 203 may be disposed closest to each other and may be disposed closest to the first assembly string connector 541 among the first to fourth assembly string connectors. The second shell string connector 202 and the fourth shell string connector 204 may be disposed closest to each other and may be disposed closest to the second assembly string connector 542 among the first to fourth assembly string connectors. The fifth shell string connector 205 and the seventh shell string connector 207 may be disposed closest to each other and may be disposed closest to the third assembly string connector 543 among the first to fourth assembly string connectors. The sixth shell string connector 206 and the eighth shell string connector 208 may be disposed closest to each other and may be disposed closest to the fourth assembly string connector 544 among the first to fourth assembly string connectors.

According to the string arrangement, one string may have a sufficient length such that the tensile force applied to the string is dispersed and vibration damping ability is improved. According to this embodiment, the distributed strings may have a square shape. However, embodiments are not limited to this shape. For example, the string may include three strings and the distributed strings may have a triangle shape. In addition, the string may include five strings or more and the distribution shape of the strings may be a pentagon or more.

According to this embodiment, the second string 902 and the third string 903 may each damp vibration of the compressor assembly 40 generated in the forward and rearward direction. In addition, the first string 901 and the fourth string 904 may each damp vibration of the compressor assembly 40 generated in the horizontal direction. In addition, all strings may damp rotational vibration.

According to this embodiment, both ends of each of the strings extending from different positions and in different directions are tensioned straight in a linear direction when both ends of each of the strings extending from the different positions and in different directions are coupled to the shell. In addition, the compressor assembly 40 does not interfere with the strings in the extending direction of the strings, but the position of the compressor assembly 40 is maintained by the strings extending from the different positions and in the different directions. In this case, self-weight of the compressor assembly 40 is applied to the strings as the tensile force.

In addition, the compressor assembly 40 does not directly contact the shell 10 except for a portion indirectly connected to the shell 10 through a gas flow pipe when the compressor assembly 40 is suspended from the strings. Therefore, as vibration of the compressor assembly 40 is reduced by the string 90, the vibration is not transmitted directly to the shell 10. In addition, as the strings extending from the different positions and in the different directions maintain the position of the compressor assembly 40, even if vibration occurs in the compressor assembly 40, the compressor assembly 40 is not greatly vibrated or swung.

For example, a connecting portion between the shell string connector 20 and the shell 10 may be disposed on a line that extends in the longitudinal direction of the string 90 connected to the shell string connector 20. For example, referring to FIG. 6, the connecting portion between the first shell string connector 201 and the shell 10 and the connecting portion between the second shell string connector 202 and the shell 10 may be disposed on a line (L) that extends in the longitudinal direction of the first string 901, and the first shell string connector 201 and the second shell string connector 202 support both ends of the first string 901. In this structure, the tensile force of the string 90 is evenly applied to the connecting portion between the shell string connector 20 and the shell 10, thereby preventing damage to the connecting portion resulting from concentrated stress at one corner.

Figure 8:
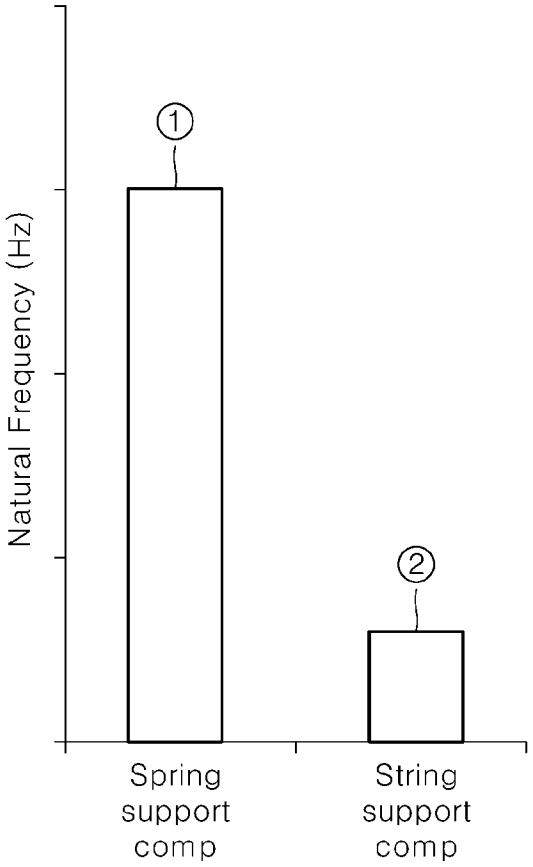
FIG. 8 is a graph comparing the natural frequency in FIG. 3 with the natural frequency in FIG. 7.
Figure 7:
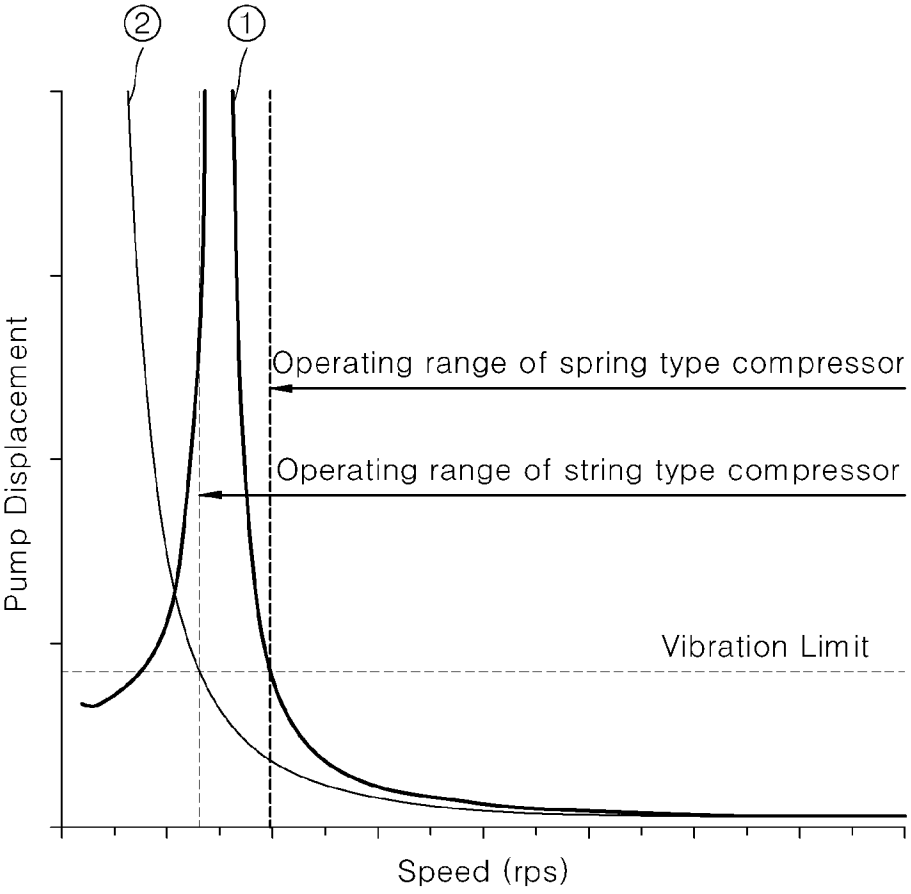
FIG. 7 is a graph showing natural frequency and an operating range of a compressor using a vibration damping structure, in addition to the graph in FIG. 3.

Referring to FIGS. 7 and 8, in contrast to damping by a spring 81 as shown in 0, when damped by a string 90 as shown in @, natural frequency is significantly lowered and a speed range in which compressor 1 may be operated may be further expanded to lower speeds.

Figure 9:
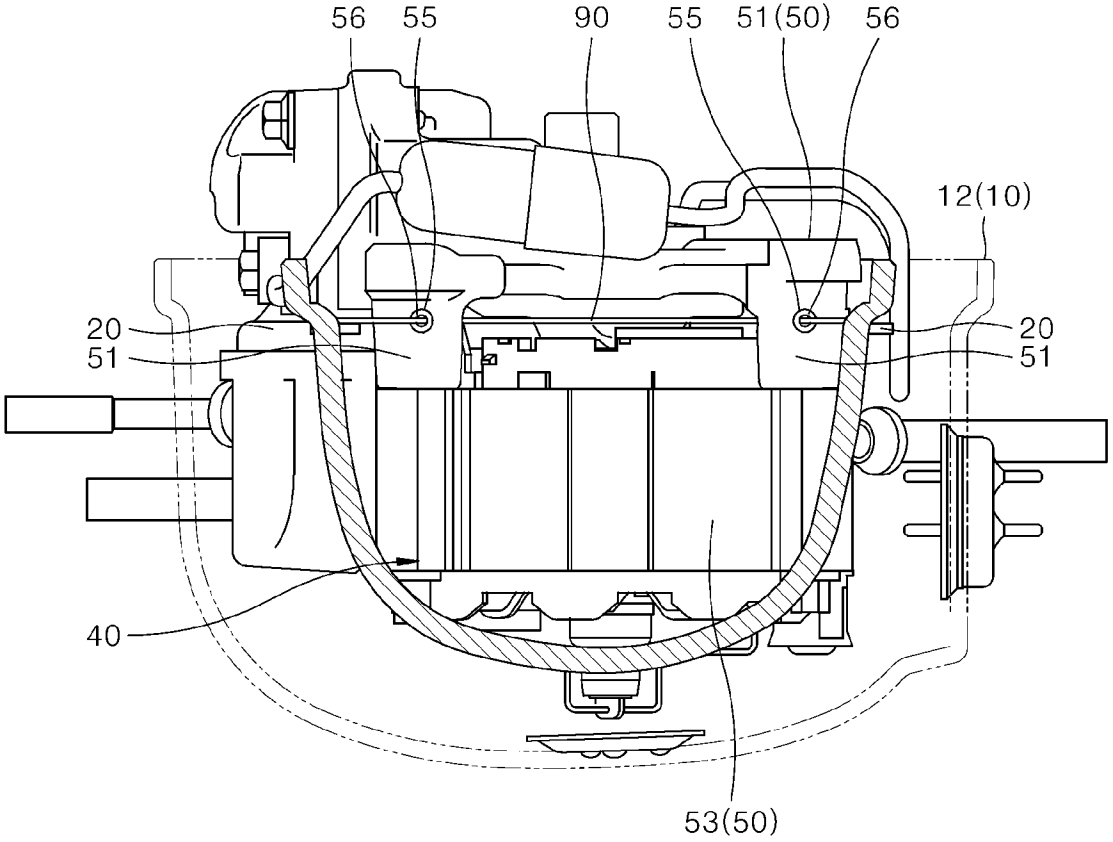
FIG. 9 is a side cross-sectional view of a compressor using a vibration damping structure according to another embodiment.
Figure 10:
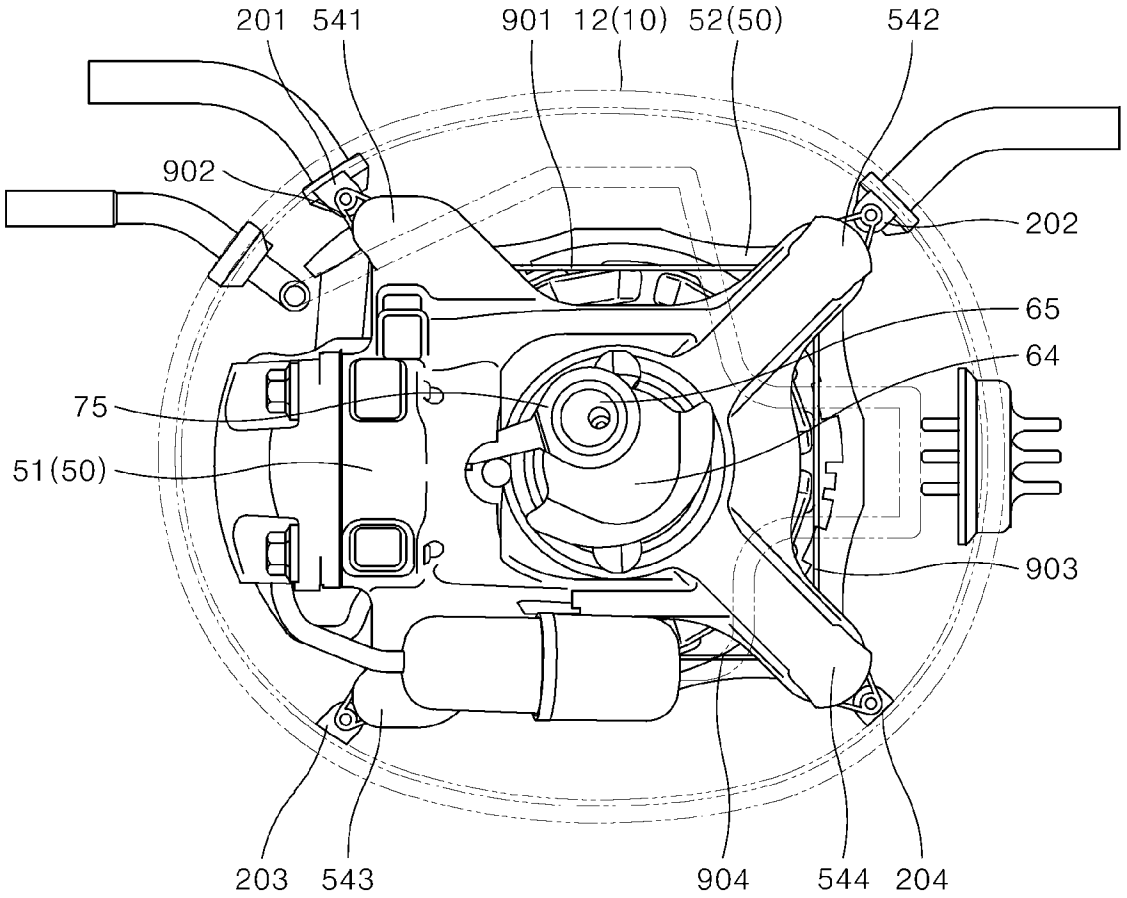
FIG. 10 is a plan view of the compressor of FIG. 9.
Figure 11:
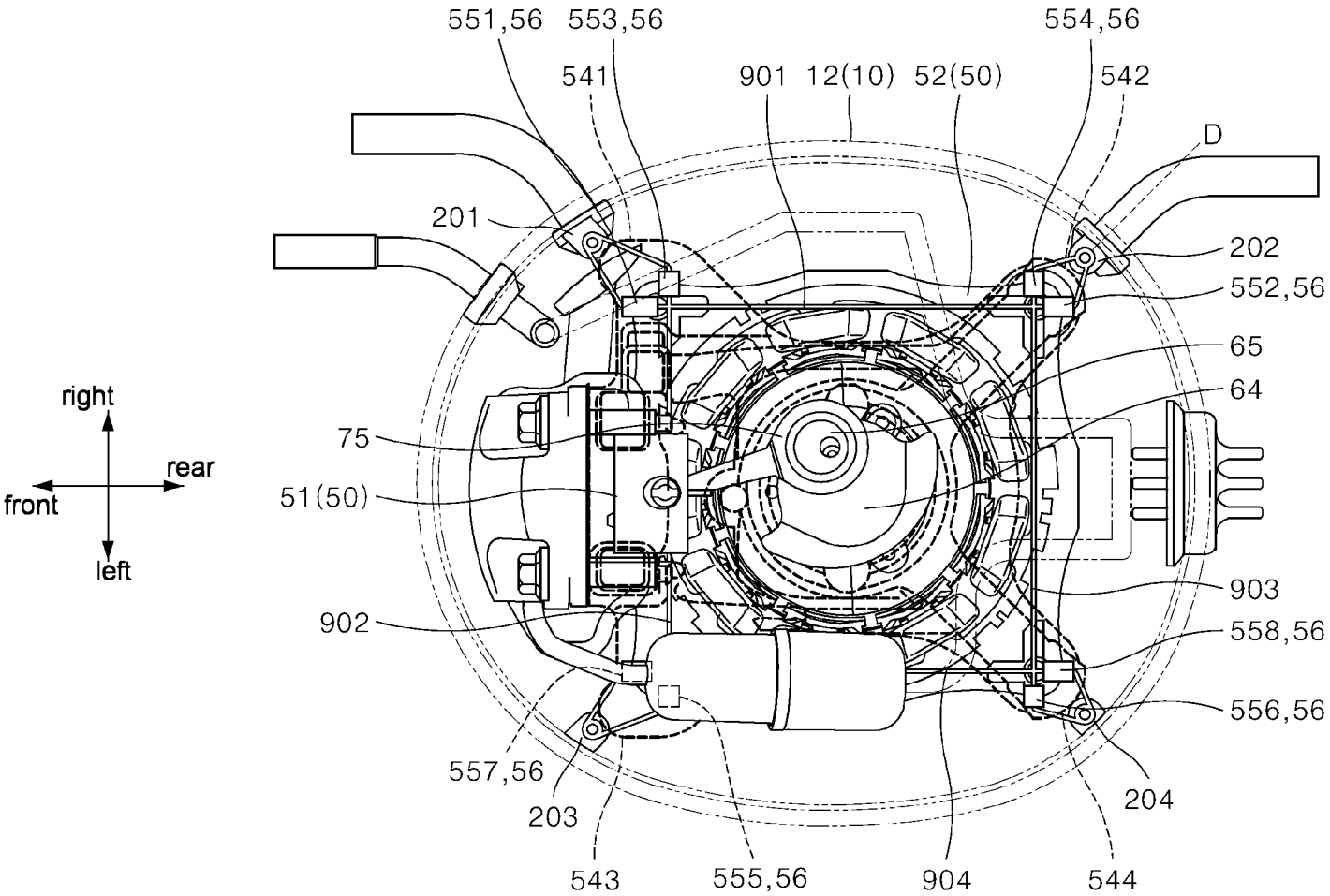
FIG. 11 shows the compressor of FIG. 10, where an upper frame is omitted.

Hereinafter, another embodiment of a vibration damping structure for expanding an operating range of compressor 1 is described with reference to FIGS. 9 to 11. FIGS. 9 to 11 show a compressor, where an upper shell is omitted.

In describing this embodiment, differences from the previous embodiment are described. Matters not described in this embodiment hereinafter may be understood with reference to other embodiments. The pair of adjacent shell string connectors in the previous embodiment is integrated into one shell string connector in this embodiment. In addition, in contrast to the previous embodiment, in the embodiment shown in FIG. 11, an extension path of the string connected to the shell string connectors at both ends is changed.

According to this embodiment, a first shell string connector 201 is disposed at a right (first) front side of the shell 10 and a second shell string connector 202 is disposed at a right (first) rear side of the shell 10. In addition, a third shell string connector 203 is disposed at a left (second) front side of the shell 10 and a fourth shell string connector 204 is disposed at a left (second) rear side of the shell 10. The first shell string connector 201 and the fourth shell string connector 204 may be opposed to each other with respect to a center of the shell 10. In addition, the second shell string connector 202 and the third shell string connector 203 may be opposite to each other with respect to the center of the shell 10.

For example, a front end, which is a first end of the first string 901, may be connected to the first shell string connector 201 disposed at the right front side of the shell 10 and a rear side, which is a second end of the first string 901 may be connected to the second shell string connector 202 disposed at the right rear side of the shell 10. In addition, a right end, which is a first end of the second string 902, may be connected to the first shell string connector 201, and a left end, which is a second end of the second string 902, may be connected to the third shell string connector 203 disposed at the left front side of the shell 10.

A right end, which is a first end of the third string 903, may be connected to the second shell string connector 202 and a left end, which is a second end of the third string 903, may be connected to the fourth shell string connector 204 disposed at the left rear side of the shell 10. In addition, a front end, which is a first end of the fourth string 904, may be connected to the third shell string connector 203 and a rear end, which is a second end of the fourth string 904, may be connected to the fourth shell string connector 204.

According to this embodiment, both ends of the strings extending from different positions and in different directions suspend the compressor assembly 40 when both ends of the string are coupled to the shell. The two strings disposed opposite to each other pull and suspend the compressor assembly 40 in opposite directions.

For example, both ends of the first string 901 coupled to the first shell string connector 201 and the second shell string connector 202 are disposed at the right side of the first through-hole 551 and the second through-hole 552. In addition, both ends of the fourth string 904 coupled to the third shell string connector 203 and the fourth shell string connector 204 are disposed at the left side of the seventh through-hole 557 and the eighth through-hole 558. In this configuration, the tensile force of the first string 901 pulls the compressor assembly 40 rightward and the tensile force of the fourth string 904 pulls the compressor assembly 40 leftward due to self-weight of the compressor assembly 40.

In addition, both ends of the second string 902 coupled to the first shell string connector 201 and the third shell string connector 203 are disposed in front of the third through-hole 553 and the fifth through-hole 555. Both ends of the third string 903 coupled to each of the second shell string connector 202 and the fourth shell string connector 204 are disposed behind the fourth through-hole 554 and the sixth through-hole 556. In this configuration, the tensile force of the second string 902 pulls the compressor assembly 40 forward, and the tensile force of the third string 903 pulls the compressor assembly 40 rearward by self-weight of the compressor assembly 40.

In this configuration, the tensile force of the strings support the compressor assembly 40 in the direction of gravity and directly support the compressor assembly 40 in the horizontal direction. Therefore, even if vibration occurs in the compressor assembly 40, the strings may maintain the position of the compressor assembly 40.

For example, according to this embodiment, the pair of strings is connected to one shell string connector 20. Directions of applying the tensile force, by the pair of strings, to one shell string connector 20 are different from each other. For example, extension directions of the pair of strings connected to the one shell string connector 20 are not parallel to or identical to each other. The connecting portion between the shell string connector 20 and the shell 10 may be disposed on a bisector (D) of an angle formed between directions of applying the tensile force to one shell string connector 20 by the pair of strings, for example, directions of extending the pair of strings from the shell string connector. For example, referring to FIG. 11, the connecting portion between the second shell string connector 202 and the shell 10 is disposed on the bisector (D) of the angle formed between a direction of connecting the first string 901 to the second shell string connector 202 and a direction of connecting the third string 903 to the second shell string connector 202.

Therefore, a direction formed by a resultant force of tensile forces applied in different directions by the two strings connected to the one shell string connector 20 may be substantially identical to the bisector (D) of the angles formed by the two directions. According to this structure, the resultant force of the tensile forces of the two strings 90 is evenly applied to the connecting portion of the shell string connector 20 and the shell 10, thereby preventing damage to the connecting portion resulting from the stress concentrated at one corner of the connecting portion.

Figure 12:
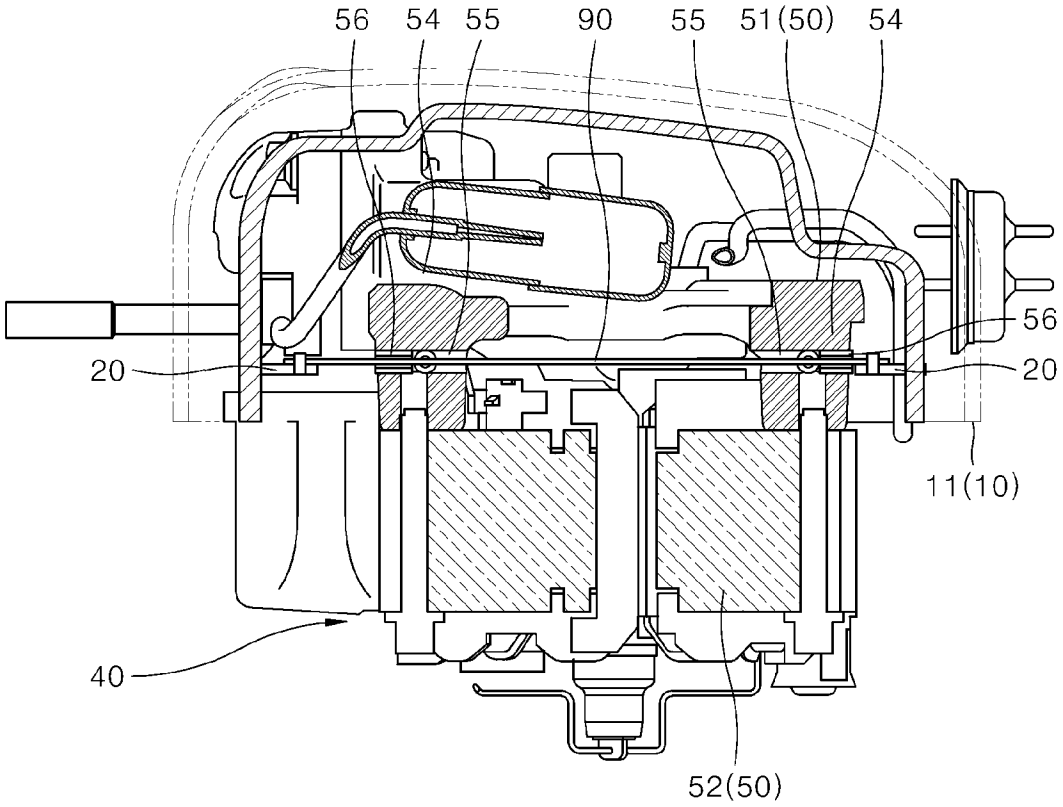
FIG. 12 is a side cross-sectional view of a compressor using a vibration damping structure according to another embodiment.
Figure 13:
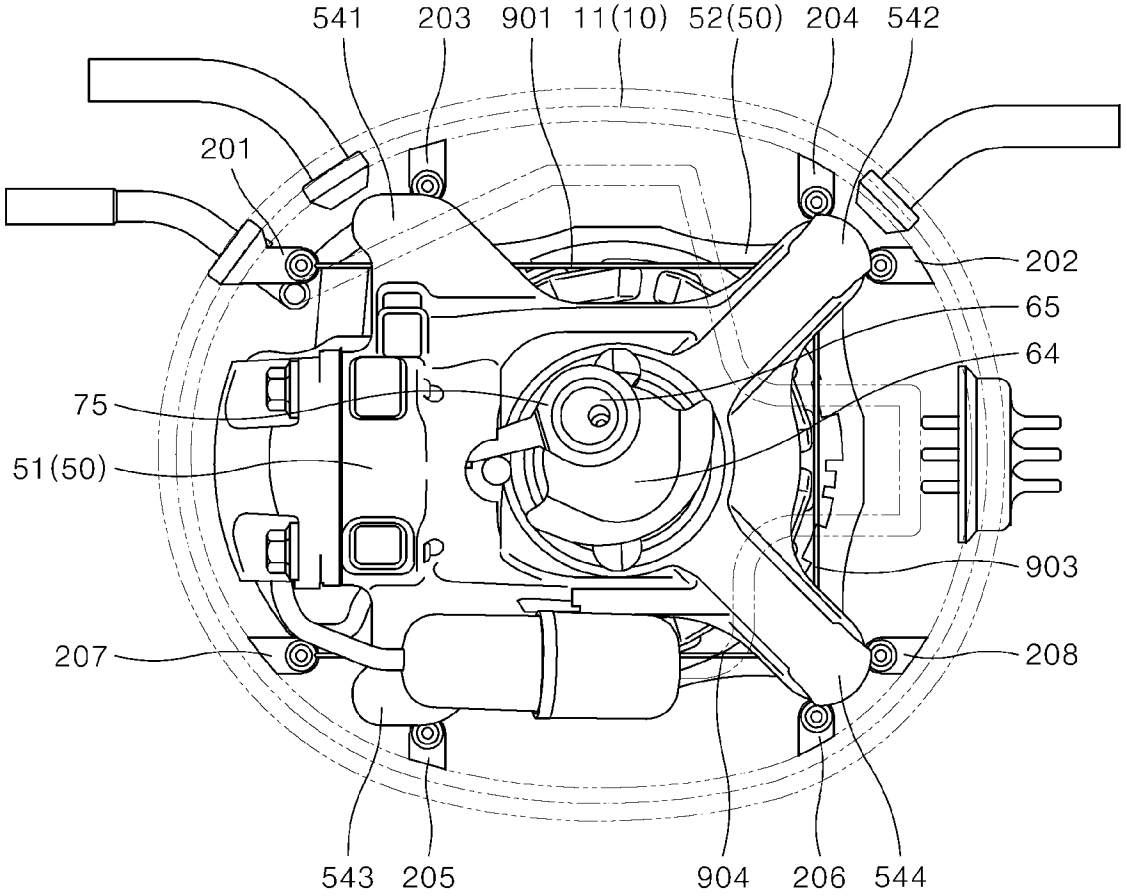
FIG. 13 is a plan view of the compressor of FIG. 12.
Figure 14:
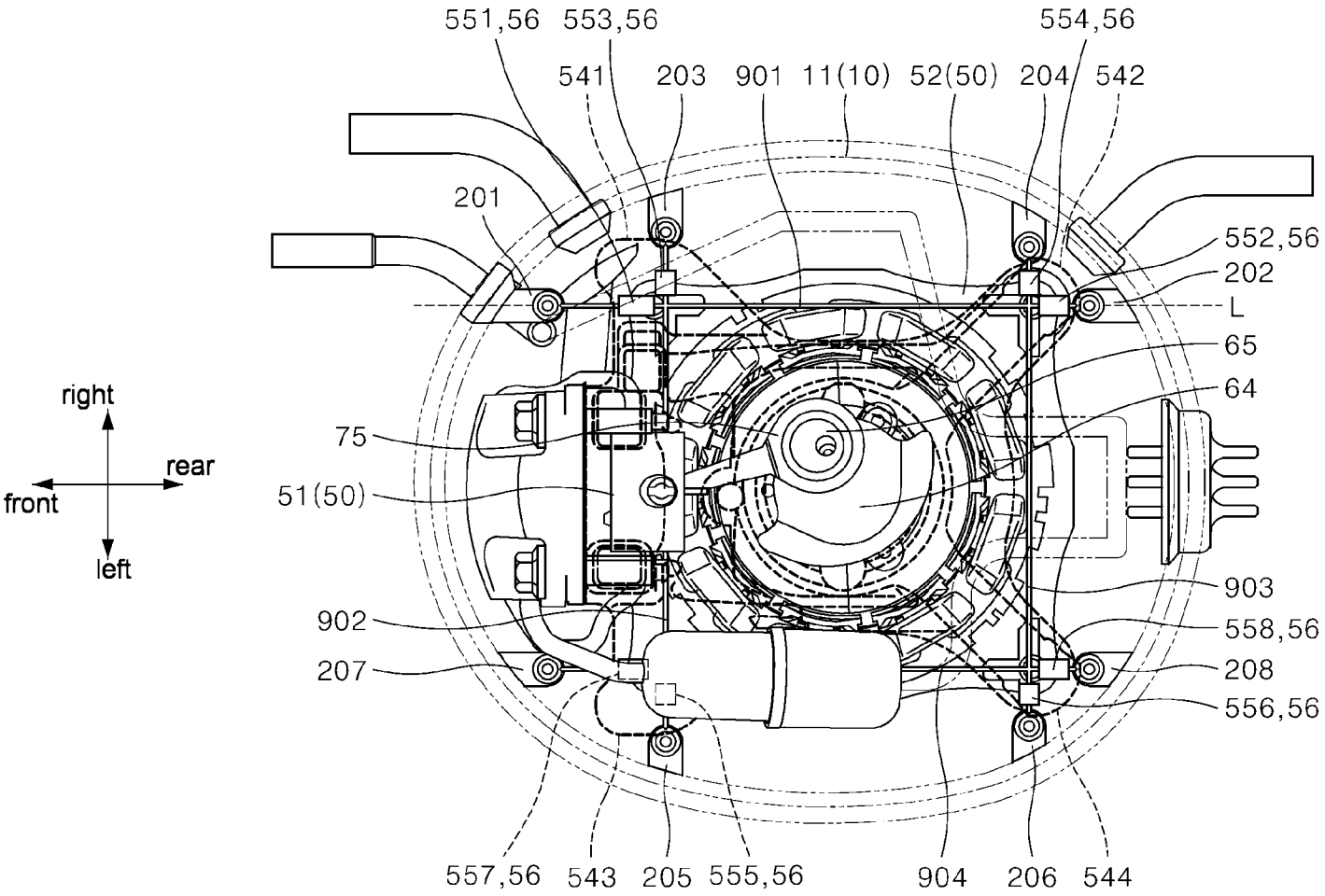
FIG. 14 shows the compressor in FIG. 13, where an upper frame is omitted.

Hereinafter, still another embodiment of a vibration damping structure for expanding an operating range of compressor 1 is described with reference to FIGS. 12 to 14. FIGS. 12 to 14 show a compressor, where a lower shell is omitted.

In describing this embodiment, differences from the previous embodiments are described. Matters not described in this embodiment below may be understood with reference to the previous embodiments. For the compressor in the previous embodiments, the shell string connector to support the strings is connected to the lower shell. For the compressor in this embodiment, a shell string connector to support the strings is connected to an upper shell. Therefore, the compressor in the previous embodiments is different from the compressor in this embodiment.

The compressor shown in FIG. 1 is assembled by placing spring 81 at the lower shell 12 and mounting the compressor assembly 40 thereon. In the previous embodiments, the compressor is assembled by hanging the string 90 inserted into the through-hole 55 of the compressor assembly 40 on the lower shell 12. In this embodiment, the compressor may be assembled by hanging the string 90 inserted into the through-hole 55 of the compressor assembly 40 on the upper shell 11 and coupling the upper shell 11 to the lower shell 12.

Various assembly methods may be selected depending on whether the string 90 is connected to any one of the upper shell or the lower shell 12.

In the embodiments disclosed herein, the shell 10 may include lower shell 12 and upper shell 11 and the string 90 connected to the lower shell 12 or the upper shell 1. However, the shell 10 need not be necessarily divided into two components, for example, the lower shell 12 and the upper shell 11.

For example, the shell 10 may further include the lower shell 12, the upper shell 11, and a middle shell disposed between the lower shell 12 and the upper shell 11, and the string 90 may be connected to the middle shell. The middle shell may have a ring structure. In this structure, if the compressor assembly 40 is disposed at the upper portion of the shell 10, the upper shell 11 may be removed for maintenance, and if the compressor assembly 40 is disposed at the lower portion of the shell 10, the lower shell 12 may be removed to perform the maintenance. Therefore, when maintenance for the shell 10 is performed, the connecting portion between the string 90 and the shell 10 may not need to be separated. Thus, a supporter to support the strings 90, such as the ring-shaped middle shell, may be manufactured as a separate component from the shell, and the supporter may be detachably coupled to the shell, thereby facilitating assembly and maintenance of the compressor.

Hereinafter, various embodiments of connection of string 90 and a shell string connector are described with reference to FIGS. 15 to 18.

Figure 15C:
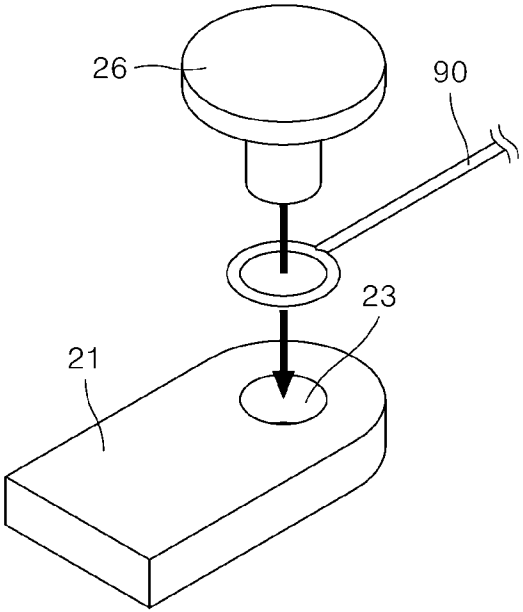
FIGS. 15A to 18C show various embodiments of a mechanism for connecting a string to a shell string connector.
Figure 15B:
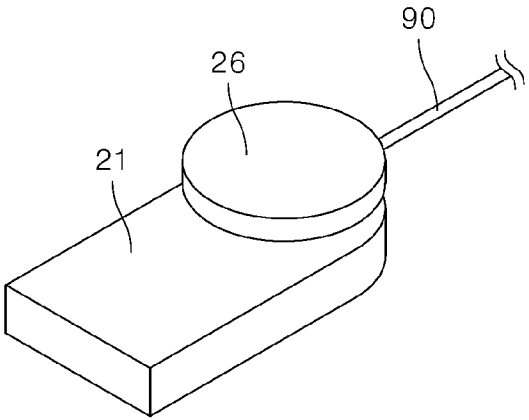
Figure 15A:
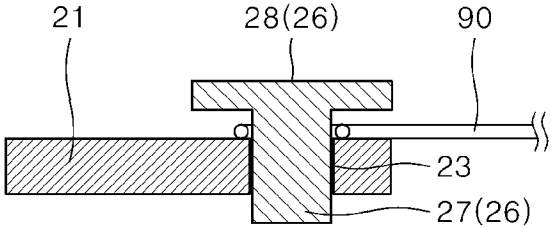

Referring to FIGS. 15A-15C, a shell string connector 20 may include a connecting member 21 connected to shell 10. The connecting member 21 may be directly connected to the shell 10 or may be indirectly connected to the shell 10 through the supporter.

The connecting member 21 may include a fitting hole 23. The fitting hole 23 may have a vertically penetrating shape.

A fixing pin 26 may be inserted into the fitting hole 23. The fixing pin 26 may include a pin 27 press-fitted into the fitting hole 23, and a head 28 disposed at an end of the pin 27. The head 28 may have a cross-section larger than a cross-section of the pin 27.

The string 90 may include a ring at an end thereof. When the fixing pin 26 is inserted through the ring and into the fitting hole 23, the ring may be caught by the pin 27 and disposed between the head 28 and the connecting member 21.

Figure 16C:
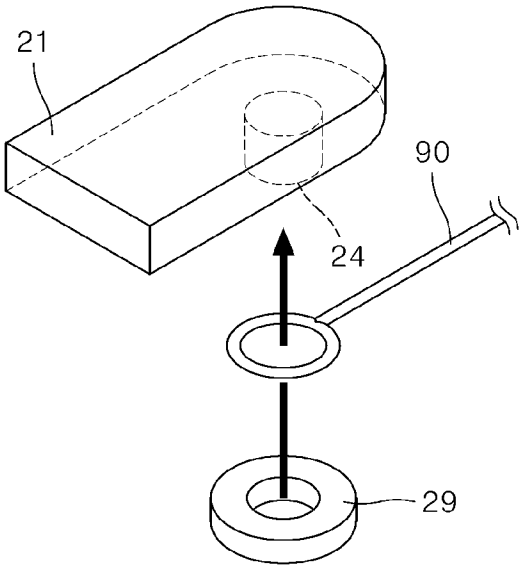
Figure 16B:
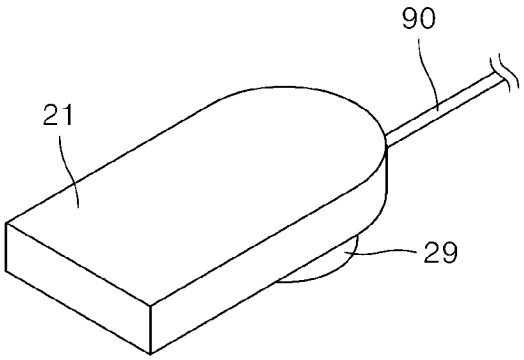
Figure 16A:
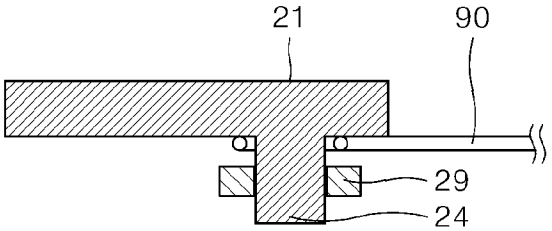

Referring to FIGS. 16A-16C, a shell string connector 20 may include connecting member 21 connected to shell 10. The connecting member 21 may define a protruding boss 24.

The boss 24 may be inserted into the ring member 29. The ring member 29 may be press-fitted to an outer periphery of the boss 24.

When the ring member 29 is fitted on the outer periphery of the boss 24 with the ring of the string 90 being caught by the boss 24, the ring may be disposed between the ring member 29 and the connecting member 21 with the ring being caught by the boss 24.

Figure 17A:
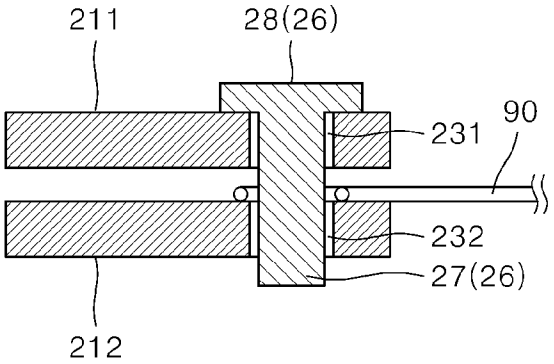
Figure 17B:
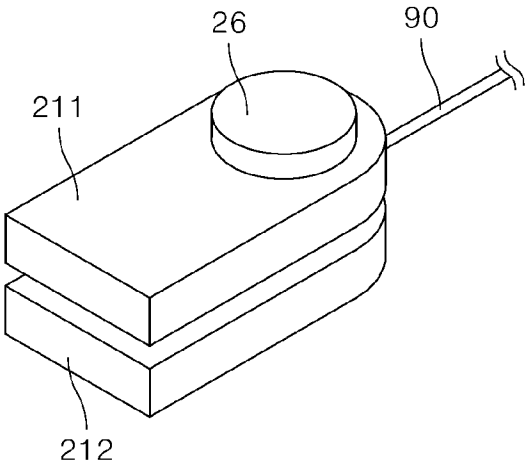
Figure 17C:
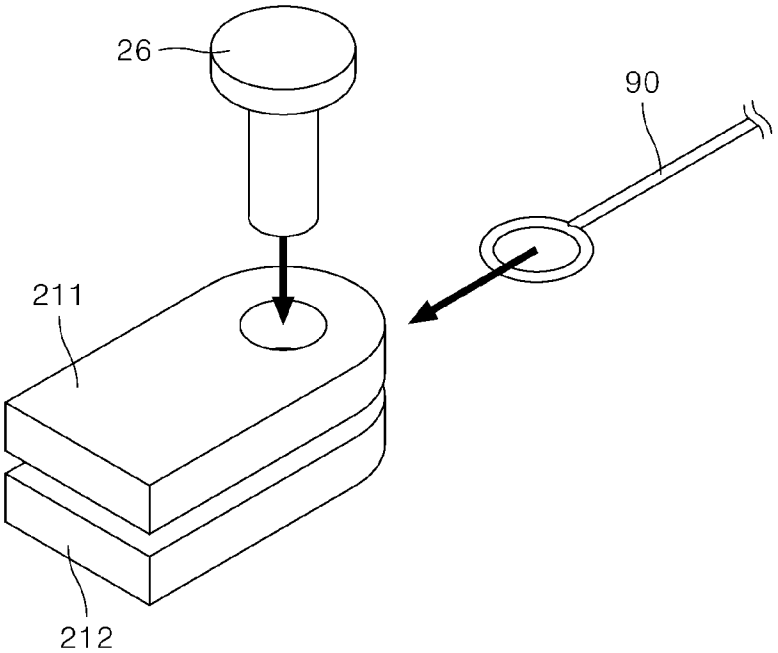

Referring to FIG. 17A-17C, shell string connector 20 may include a pair of connecting members 21 connected to shell 10. The pair of connecting members 21 may include first connecting member 211 and second connecting member 212 arranged side by side by a predetermined distance.

The first connecting member 211 may include a first fitting hole 231, and the second connecting member 212 may include a second fitting hole 232. Positions of the two fitting holes 231 and 232 may correspond to each other.

A fixing pin 26 may be inserted into the pair of fitting holes 231 and 232. The fixing pin 26 may include pin 27 press-fitted into the pair of fitting holes 231 and 232, and head 28 disposed at an end of the pin 27. The head 28 may have a cross section greater than a cross section of the pin 27.

The string 90 may include a ring at an end thereof. When the ring is disposed between the pair of connecting members and the fixing pin 26 is inserted into the pair of fitting holes 231 and 232 through the ring, the ring may be caught by the pin 27 and is disposed between the pair of connecting members 211 and 212.

Figure 18A:
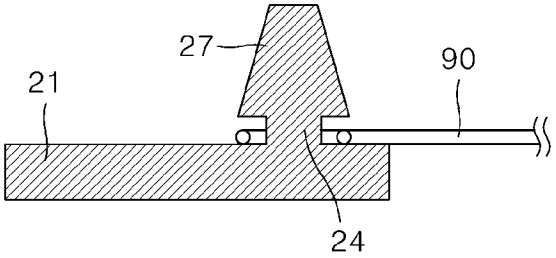
Figure 18B:
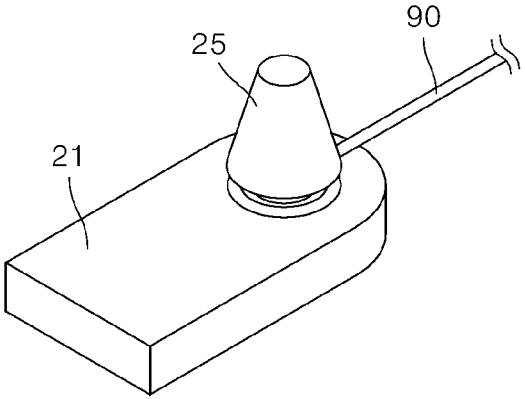
Figure 18C:
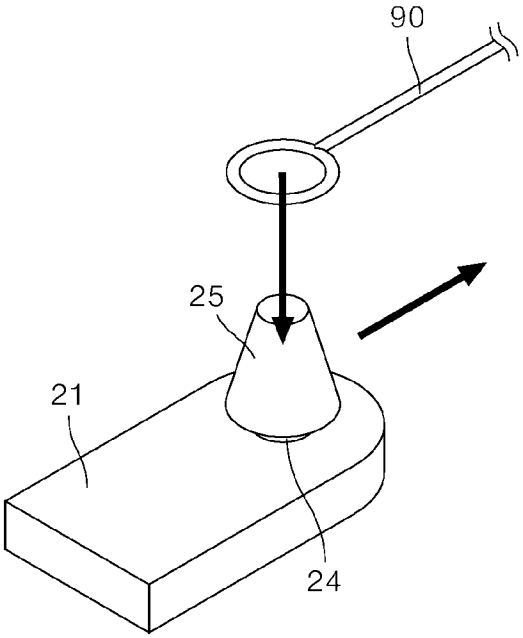

Referring to FIGS. 18A-18C, shell string connector 20 may include connecting member 21 connected to shell 10. The connecting member 21 may define protruding boss 24. In addition, boss head 25 may be integrated with the boss 24 at an end of the boss 24. The boss head 25 may have a greater cross section that a cross section of the boss 24 and may have a cross section reduced toward a top of the boss head 25. In this configuration, the boss head 25 may have a truncated cone shape.

The ring of the string 90 may be caught by the boss 24 through the boss head 25. The ring may be disposed between the boss head 25 and the connecting member 21 when the ring is caught by the boss 24.

Embodiments have been conceived to solve above-described problems, and provide a vibration damping structure capable of expanding an operating speed range in which a compressor may be operated by avoiding an M-K vibration system having a low natural frequency and a compressor using a vibration damping structure. Embodiments disclosed herein provide a vibration damping structure having excellent damping capacity in a direction of gravity and a horizontal direction, and a compressor using a vibration damping structure. Embodiments disclosed herein also provide a vibration damping structure to facilitate assembly and reduce manufacturing costs, and a compressor having a vibration damping structure.

In order to solve the above-described problems, embodiments disclosed herein provides a vibration damping structure to damp vibration based on tensile force of a string by suspending a compressor assembly on the string, and a compressor using a vibration damping structure.

The string may not resist a compression force, but may resist the tensile force, in a longitudinal direction. Examples of string may include a wire, a rope, or a cable, for example.

The compressor may include a shell and a compressor assembly. The shell may isolate or separate an inner space of the compressor and an outer space of the compressor.

The compressor assembly may be disposed in a space inside of the shell. The compressor assembly may be configured to compress gas and induce vibration.

The compressor assembly may include a frame, a cylinder disposed in the frame and defining a bore, and a piston inserted into the bore of the cylinder and configured to linearly reciprocate to compress the gas. The shell and the compressor assembly may be connected to each other by the strings.

The compressor assembly may include an assembly string connector to connect to the string. The shell may include a shell string connector to connect to the string.

The tensile force may be configured to be generated at the string due to self-weight of the compressor assembly. The compressor assembly may be suspended from the shell through or by the string.

The frame of the compressor assembly may not directly contact the shell. The assembly string connector may be disposed at the frame.

The assembly string connector may include a through-hole. The string may pass through the through-hole, and a first end and a second end of the string may be connected to the shell string connector. The through-hole may be defined in the frame.

The shell string connector may include a first shell string connector, and a second shell string connector which is spaced apart from the first shell string connector. The first end of the string may be connected to the first shell string connector and the second end of the string may be connected to the second shell string connector.

The assembly string connector may include a first assembly string connector, and a second assembly string connector which is spaced apart from each other. The first assembly string connector and the second assembly string connector may each include a through-hole. A penetrating direction of the through-hole of the first assembly string connector and a penetrating direction of the through-hole of the second assembly string connector may be substantially disposed on one straight line. The string may pass through each of the through-hole of the first assembly string connector and the through-hole of the second assembly string connector.

The first assembly string connector may include a first through-hole penetrating in a first direction, the second assembly string connector may include a second through-hole penetrating in a second direction, the first assembly string connector may further include a third through-hole penetrating in a third direction, and the second assembly string connector may further include a fourth through-hole penetrating in a fourth direction. The first direction and the second direction may be substantially arranged on one straight line.

The string may include a first string that passes through the first through-hole and the second through-hole, a second string that passes through the third through-hole, and a third string that passes through the fourth through-hole.

A first end of the first string may be connected to the first shell string connector and a second end of the first string may be connected to the second shell string connector which is spaced apart from the first shell string connector.

As an example of a connecting position of the string, a first end of the second string may be connected to a third shell string connector adjacent to the first shell string connector by a first distance, a first end of the third string may be connected to a fourth shell string connector adjacent to the second shell string connector by a second distance, and the third shell string connector and the fourth shell string connector are spaced apart from each other by a third distance. The first distance and the second distance may each be less than the third distance.

A fifth shell string connector may be spaced apart from each of the first to the fourth shell string connectors. A second end of the second string may be connected to a fifth shell string connector. A distance between the fifth shell string connector and each of the first to fourth shell string connector may be a distance greater than each of the first distance and the second distance.

A sixth shell string connector may be spaced apart from each of the first to the fourth shell string connectors. A second end of the third string may be connected to the sixth shell string connector. A distance between the sixth shell string connector and each of the first to the fourth shell string connectors may be a distance greater than each of the first distance and the second distance.

A distance between the fifth shell string connector and the sixth shell string connector may be a distance greater than each of the first distance and the second distance. A figure formed by the strings may be a quadrangle or more.

The distance between the fifth shell string connector and the sixth shell string connector may be similar to or substantially the same as the third distance. A figure formed by the strings may be a quadrangle.

For example, a distance between the fifth shell string connector and the sixth shell string connector may be similar to or substantially the same as each of the first distance and the second distance. A figure formed by the strings may be a triangular shape.

As another example of a connecting position of the string, a first end of the second string may be connected to the first shell string connector and a first end of the third string may be connected to the second shell string connector. The second end of the second string may be connected to a third shell string connector which is spaced apart from each of the first shell string connector and second shell string connector. The second end of the third string may be connected to a fourth shell string connector which is spaced apart from each of the first shell string connector and the third shell string connector. A figure formed by the strings may be a quadrangle or more.

The distance between the first shell string connector and the second shell string connector may be similar to or substantially the same as the distance between the third shell string connector and the fourth shell string connector. A figure formed by the strings may be a quadrangle.

For example, the second end of the third string may be connected to the third shell string connector. A figure formed by the strings may be a triangular shape.

The through-hole may include a surface at an inner circumference thereof. The surface of the through-hole may contact the string and minimize abrasion of the string due to low coefficient of friction (COF) with the string. For example, a bushing may be disposed on an inner periphery of the through-hole and contact the string.

The shell string connector may include a connecting member connected to the shell; a fitting hole defined in the connecting member; and a pin inserted into the fitting hole and a head disposed at an end of the pin. The string may be caught by the pin and may be connected to the shell string connector between the head and the connecting member.

As another example, the shell string connector may include a first connecting member and a second connecting member which are spaced apart from each other by a predetermined distance and connected to the shell; a first fitting hole and a second fitting hole defined respectively at the first connecting member and the second connecting member; and a fixing pin including a pin inserted into the first fitting hole and the second fitting hole, and a head disposed at the end of the pin. The string may be caught by the pin and connected to the shell string connector between the first connecting member and the second connecting member.

The shell string connector may include a connecting member connected to the shell; a boss that protrudes from the connecting member; and a ring member fitted on an outer periphery of the boss. The string may be caught by the boss and connected to the shell string connector between the connecting member and the ring member.

The shell string connector may include a connecting member connected to the shell; a boss that protrudes from the connecting member; and a boss head disposed at an end of the boss. The string may be caught by the boss and connected to the shell string connector between the connecting member and the boss head.

The shell of the compressor using the vibration damping structure may include a lower shell defining a lower portion of the compressor, and an upper shell defining an upper portion of the compressor and coupled to the lower shell. The shell string connector may be connected to the lower shell. The shell string connector may be connected to the upper shell.

In contrast to the MK system in related art, as the vibration damping structure of the compressor according to embodiments disclosed herein connects the compressor assembly to the shell based on the tensile force of the string, natural frequency does not exist, thereby expanding the speed range in which the compressor can be operated.

According to embodiments disclosed herein, the tensile force of the string may provide an excellent damping force in the direction of gravity and in the horizontal direction. Therefore, a number of components may be reduced and assembly simplified, thereby reducing manufacturing costs.

Although embodiments have been described as described above with reference to exemplary drawings, the embodiments are not limited to the embodiments and drawings disclosed herein, and various modifications may be made by those skilled in the art within the scope of the technical idea. In addition, even if working effects obtained based on configurations are not explicitly described in the description of embodiments, effects predictable based on the corresponding configuration have to be recognized.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vibration damping structure for a compressor, the compressor being configured to compress gas, the vibration damping structure, comprising:

a compressor assembly including a frame, a cylinder disposed in the frame and defining a bore, and a piston inserted into the bore of the cylinder and configured to linearly reciprocate to compress the gas;

a string configured to connect the compressor assembly to a shell of the compressor;

an assembly string connector disposed on the compressor assembly and connected to the string; and a shell string connector disposed on the shell and connected to the string, wherein the assembly string connector comprises a through-hole, wherein the string passes through the through-hole, wherein the string is configured not to be coupled to the assembly string connector in a longitudinal direction of the string, and wherein a tensile force is configured to be generated at the string due to self-weight of the compressor assembly and the compressor assembly is suspended from the shell by the string.

2. The vibration damping structure of claim 1, wherein the assembly string connector is disposed on the frame.

3. The vibration damping structure of claim 1, wherein the assembly string connector comprises a first assembly string connector and a second assembly string connector, which are spaced apart from each other.

4. The vibration damping structure of claim 3, wherein a first end of the string is connected to a first shell string connector of the shell string connector, and wherein a second end of the string is connected to a second shell string connector of the shell string connector.

5. The vibration damping structure of claim 1 wherein the through-hole comprises a bushing at an inner circumference thereof and the bushing contacts the string.

6. The vibration damping structure of claim 1, wherein the assembly string connector comprises a first assembly string connector and a second assembly string connector, which are spaced apart from each other, wherein the first assembly string connector and the second assembly string connector each comprises a through-hole, and wherein the string passes through each of the through-hole of the first assembly string connector and the through-hole of the second assembly string connector.

7. The vibration damping structure of claim 6, wherein a penetrating direction of the through-hole of the first assembly string connector and a penetrating direction of the through-hole of the second assembly string connector are substantially arranged on a straight line.

8. The vibration damping structure of claim 6, wherein a first end of the string is connected to a first shell string connector of the shell string connector, wherein a second end of the string is connected to a second shell string connector of the shell string connector, and wherein the second shell string connector is spaced apart from the first shell string connector.

9. The vibration damping structure of claim 1, wherein the assembly string connector comprises a first assembly string connector and a second assembly string connector, which are spaced apart from each other, wherein the first assembly string connector comprises a first through-hole penetrating in a first direction, wherein the second assembly string connector comprises a second through-hole penetrating in a second direction, wherein the first assembly string connector further comprises a third through-hole penetrating in a third direction, wherein the second assembly string connector further comprises a fourth through-hole penetrating in a fourth direction, wherein the string comprises a first string that passes through each of the first through-hole and the second through-hole, a second string that passes through the third through-hole, and a third string that passes through the fourth through-hole.

10. The vibration damping structure of claim 9, wherein the first direction and the second direction are substantially arranged on a straight line.

11. The vibration damping structure of claim 9, wherein a first end of the first string is connected to a first shell string connector of the shell string connector, and wherein a second end of the first string is connected to a second shell string connector of the shell string connector, which is spaced apart from the first shell string connector.

12. The vibration damping structure of claim 11, wherein a first end of the second string is connected to a third shell string connector of the shell string connector adjacent to the first shell string connector, wherein a first end of the third string is connected to a fourth shell string connector of the shell string connector adjacent to the second shell string connector, and wherein the third shell string connector and the fourth shell string connector are spaced apart from each other.

13. The vibration damping structure of claim 12, wherein a second end of the second string is connected to a fifth shell string connector of the shell string connector spaced apart from each of the first to fourth shell string connectors, and wherein a second end of the third string is connected to a sixth shell string connector of the shell string connector spaced apart from each of the first to fourth shell string connectors.

14. The vibration damping structure of claim 11, wherein a first end of the second string is connected to the first shell string connector, and wherein a first end of the third string is connected to the second shell string connector.

15. The vibration damping structure of claim 14, wherein a second end of the second string is connected to a third shell string connector of the shell string connector spaced apart from each of the first shell string connector and the second shell string connector.

16. A compressor, comprising:

a shell that separates an inner space of the compressor from an outside of the compressor;

a compressor assembly accommodated in the shell, the compressor assembly comprising a frame, a cylinder disposed in the frame and defining a bore, and a piston inserted into the bore of the cylinder and configured to linearly reciprocate to compress a gas;

a string that connects the compressor assembly and the shell;

an assembly string connector disposed on the compressor assembly and connected to the string; and a shell string connector disposed on the shell and connected to the string, wherein the assembly string connector comprises a through-hole, wherein the string passes through the through-hole, wherein the string is configured not to be coupled to the assembly string connector in a longitudinal direction of the string, and wherein a tensile force is configured to be generated at the string due to self-weight of the compressor assembly and the compressor assembly is suspended from the shell by the string.

17. The compressor of claim 16, wherein the shell comprises a lower shell defining a lower portion of the compressor and an upper shell defining an upper portion of the compressor and coupled to the lower shell, and wherein the shell string connector is connected to one of the upper shell or the lower shell.

18. The compressor of claim 16, wherein the shell string connector comprises:

a connecting member connected to the shell; and a fixing pin comprising a pin connected to the connecting member and a head disposed at an end of the pin, and wherein the string is caught by and connected to the pin between the head and the connecting member.

19. A vibration damper for a compressor, the compressor including a compressor assembly configured to compress gas, the vibration damper comprising:

at least one string configured to connect the compressor assembly to a shell of the compressor;

an assembly string connector configured to be disposed on the compressor assembly and connected to the at least one string; and a shell string connector configured to be disposed on the shell and connected to the at least one string, wherein the assembly string connector comprises a through-hole, wherein the at least one string passes through the through-hole, wherein the at least one string is configured not to be coupled to the assembly string connector in a longitudinal direction of the at least one string, and wherein a tensile force is configured to be generated at the at least one string due to self-weight of the compressor assembly and the compressor assembly is suspended from the shell by the at least one string.

20. The vibration damper of claim 19, wherein a first end of the at least one string is connected to a first shell string connector of the shell string connector, and wherein a second end of the at least one string is connected to a second shell string connector of the shell string connector, which is spaced apart from the first shell string connector.

* * * * *